United States Patent [19]

Kasai

[11] Patent Number: 4,765,038

[45] Date of Patent: Aug. 23, 1988

[54] WATERTIGHT SLIDE FASTENER STRINGER

[75] Inventor: Kazumi Kasai, Namerikawa, Japan

[73] Assignee: Yoshida Kogyo K. K., Tokyo, Japan

[21] Appl. No.: 11,408

[22] Filed: Feb. 4, 1987

Related U.S. Application Data

[63] Continuation of Ser. No. 783,273, Oct. 3, 1985, which is a continuation of Ser. No. 530,099, Sep. 7, 1983.

[30] Foreign Application Priority Data

Sep. 9, 1982 [JP] Japan ..... 57-136968[U]
Jul. 22, 1983 [JP] Japan ..... 58-113994[U]

[51] Int. Cl.[4] ..... A44B 19/32

[52] U.S. Cl. ..... 24/389; 24/398; 24/410

[58] Field of Search ..... 24/389, 403, 405, 409, 24/410, 413, 397, 398

[56] References Cited

U.S. PATENT DOCUMENTS

| | | | |
|---|---|---|---|
| 2,371,591 | 3/1945 | Cizek | 24/410 |
| 2,477,563 | 8/1949 | Angus | 24/389 |
| 2,526,600 | 10/1950 | Bolten | 24/410 |
| 3,022,560 | 2/1962 | Morin | 24/410 X |
| 3,055,069 | 9/1962 | Morin | 24/410 |
| 3,886,634 | 6/1975 | Murata | 24/410 |
| 4,100,656 | 7/1978 | Moertel | 24/398 |
| 4,312,102 | 1/1982 | Fukurdi | 24/389 |

FOREIGN PATENT DOCUMENTS

| | | | |
|---|---|---|---|
| 209493 | 11/1955 | Australia | 24/410 |
| 572613 | 3/1959 | Canada | 24/389 |
| 2339469 | 2/1974 | Fed. Rep. of Germany | 24/410 |
| 2461820 | 7/1975 | Fed. Rep. of Germany | 24/398 |
| 2461844 | 7/1975 | Fed. Rep. of Germany | 24/403 |
| 2031971 | 11/1970 | France | 24/389 |
| 879771 | 10/1961 | United Kingdom | 24/389 |
| 1418585 | 12/1975 | United Kingdom | 24/403 |

*Primary Examiner*—Kenneth J. Dorner
*Assistant Examiner*—Laurie K. Cranmer
*Attorney, Agent, or Firm*—Hill, Van Santen, Steadman & Simpson

[57] ABSTRACT

A watertight slide fastener stringer comprises a series of coupling elements mounted on a watertight stringer tape along a longitudinal edge portion thereof. Each coupling element includes a pair of upper and lower halves or members disposed one on each side of the stringer tape and joined by at least one integral connector extending through the stringer tape. Each of the coupling element members has a coupling portion including a support portion disposed on a thickened sealing member which is disposed on the longitudinal tape edge, a neck portion on the support portion, and a coupling head on the support portion integral with the neck and projecting beyond the thickened sealing member. The support portion and the neck portion jointly define therebetween a pair of recesses opening away from the plane of the stringer tape for receiving therein the coupling heads of mating coupling elements. A layer made of a cured adhesive material is disposed on each side of the stringer tape at least around the integral connector to prevent water leakage between opposite sides of the coupled fastener stringers.

7 Claims, 5 Drawing Sheets

WATERTIGHT SLIDE FASTENER STRINGER

This is a continuation of application Ser. No. 783,273, filed Oct. 3, 1985, which is a continuation of application Ser. No. 530,099, filed Sept. 7, 1983.

BACKGROUND OF THE INVENTION

1. Field of the Invention:

The present invention relates to slide fasteners, and more particularly to a watertight slide fastener.

2. Prior Art

There have been proposed many watertight slide fasteners comprising a pair of opposed waterproof stringer tapes and seal means for protection against water leakage between intermeshing rows of coupling elements mounted by extrusion molding on the respective stringer tapes along their inner longitudinal edges.

A typical example of such known watertight slide fastener stringers is disclosed in U.S. Pat. No. 4,312,102, patented Jan. 26, 1982. The disclosed fastener stringer includes a stringer tape made of synthetic rubber and a series of coupling elements mounted on a longitudinal edge portion of the stringer tape. The stringer tape has a thickened sealing member along the longitudinal edge portion. Each coupling element includes a pair of members one on each side of the tape, and a connector extending through the tape and interconnecting the members, each coupling element member having a reduced neck on the sealing member and a coupling head projecting beyond the sealing member. The coupling heads jointly define a groove extending longitudinally along the sealing member, and the sealing member has a surface facing into the groove. When two such stringers are coupled together, the surfaces of the sealing member are brought together into sealing contact, and the interengaging coupling heads are supported by longitudinal portions of the respective sealing members extending between the necks of two adjacent ones of the coupling elements.

With the slide fastener stringers thus arranged, the surfaces of the sealing member are likely to separate when a severe lateral pulling force is applied to the tapes. Further, when subjected to a severe thrust applied perpendicularly to the plane of the slide fastener, the interengaging coupling heads tend to yield in a direction away from the tape. Under heavier load conditions such as occurs when the stringers are used in a diving suit for deep sea use, working might penetrate through the stringers around the respective connectors due to a great amount of pressure difference between the interior and exterior sides of the slide fastener.

SUMMARY OF THE INVENTION

It is therefore an object of the present invention to provide a watertight slide fastener stringer having coupling elements securely attached to a stringer tape along a longitudinal edge thereof.

Another object of the present invention is to provide a watertight slide fastener stringer which is reliable in fluid tightness for a wide variety of severe applications.

According to the present invention, a slide fastener stringer includes a series of coupling elements mounted on a watertight stringer tape along a longitudinal edge portion thereof. Each coupling element comprises a pair of members mounted one on each side of said stringer tape, and at least one integral connector extends through the longitudinal edge portion of the tape and interconnects the members. Each of the members has a leg portion disposed on the longitudinal edge portion, and a coupling portion extending from said leg portion partly beyond a thickened sealing member which is disposed on the longitudinal edge portion. The coupling portion has a support portion disposed on the thickened sealing member, a neck portion on the support portion extending from the leg portion, and a coupling head on the support portion joined with the neck portion and projecting beyond the sealing member. The support portion and said neck portion jointly define a pair of recesses opening away from the plane of the stringer tape for receiving therein the coupling heads of mating coupling elements. The support portion limits relative displacement of the interengaged coupling elements, particularly in a direction perpendicular to the plane of the stringer. A layer of a cured adhesive material is disposed on each side of the watertight stringer tape at least around the integral connector so that the coupled stringers are free of water leakage therethrough, even when a greater pressure difference is created between opposite sides of the stringers.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
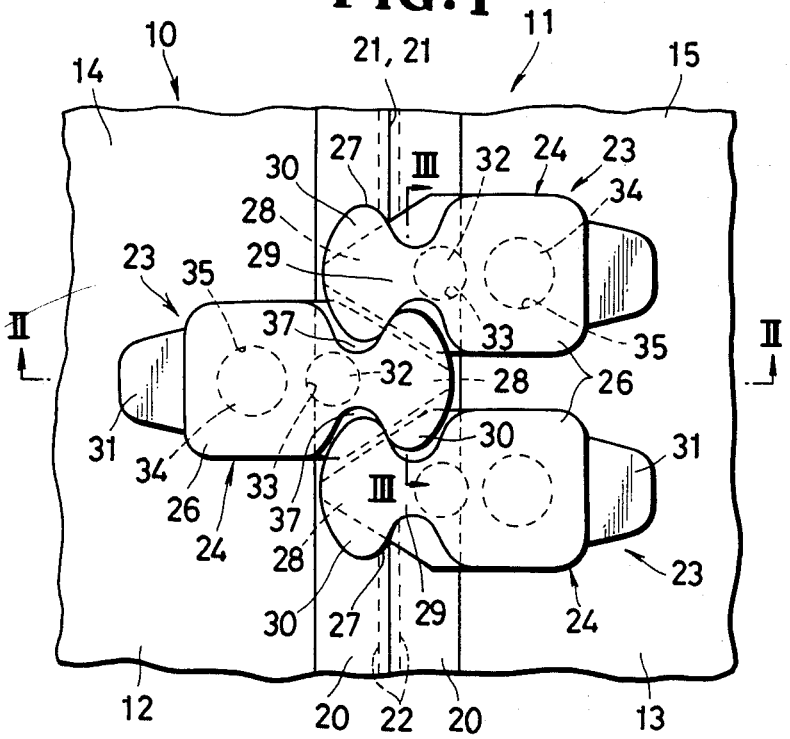
FIG. 1 is a fragmentary plan view of a pair of coupled slide fastener stringers according to the present invention.
Figure 2:
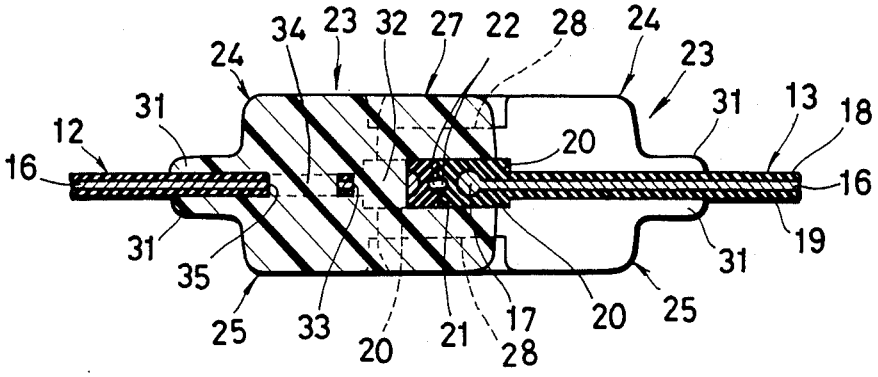
FIG. 2 is a cross sectional view taken along line II—II of FIG. 1.
Figure 3:
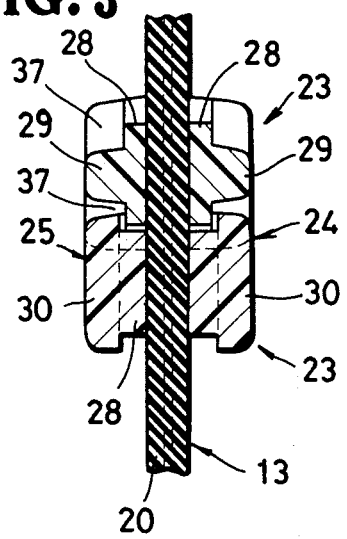
FIG. 3 is a cross sectional view taken along line III—III of FIG. 1.

As shown in FIGS. 1 and 2, a pair of watertight slide fastener stringers 10, 11 that are coupled together comprise a pair of stringer tapes 12, 13 including a pair of confronting longitudinal edge portions 14, 15, respectively. Each of the stringer tapes 12, 13 is composed of a woven or knit web core 16 (FIG. 2) having a longitudinal beaded edge 17 (FIG. 2). The web core 16 is covered with face and back layers 18, 19 (FIG. 2) of a resilient and water-resistant elastomer such as natural or synthetic rubber, the layers 18, 19 being coated or extrusion-molded on the web core 16.

Each stringer tape 12, 13 has a thickened or enlarged, resilient sealing member 20 having a thickness greater than that of the tape proper and extending along the longitudinal edge portion 14, 15, the sealing member 20 being made of the same material as that of the layers 18, 19. The thickened sealing member 20 has a sealing edge or surface 21 lying in a plane substantially perpendicular to the stringer tape 12, 13, and a groove 22 (See also FIG. 4) of a substantially semicircular cross section extending in the sealing surface 21 through the length of the sealing member 20 and opening away from the beaded edge 17. When the slide fastener stringers 10, 11 are coupled together, the sealing surfaces 21, 21 are pressed against each other so that the slide fastener stringers 10, 11 serve as a watertight slide fastener. The grooves 22, 22 serve to accomodate lateral expansion of the sealing members 20, 20 as they are forcibly pressed edgewise against each other, thereby providing a hermetic seal between the sealing surfaces 21, 21 against water leakage therebetween.

Figure 4:
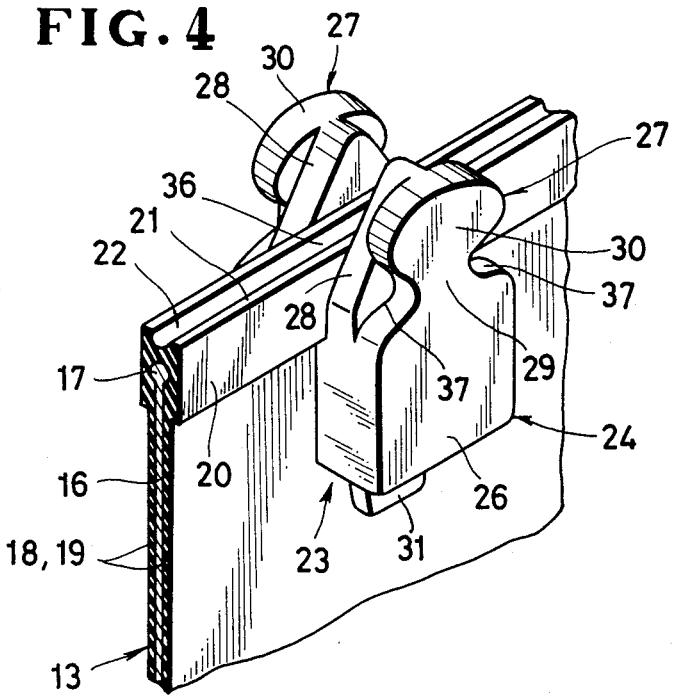
FIG. 4 is a fragmentary perspective view of one of the slide fastener stringers.

A series of coupling elements 23 (only three being shown in FIG. 1 for clarity) is mounted on each stringer tape 12, 13 along a corresponding one of the longitudinal edge portions 14, 15, the coupling elements being formed of either synthetic resin by molding or metal by die casting. As illustrated in FIG. 2, each of the coupling elements 23 comprises a pair of upper and lower members or halves 24, 25 disposed one on each side of the stringer tape 12, 13. Each of the upper and lower halves 24, 25 includes a wide leg portion 26 disposed on the longitudinal edge portion 14, 15, and a coupling portion 27 extending from the leg portion 26 partly beyond the thickened sealing member 20, 20. As best shown in FIG. 4, each coupling portion 27 has a support portion 28 extending from the leg portion 26 and disposed on the thickened sealing member 20, a reduced neck portion 29 disposed on the support portion 28 and extending from the leg portion 26, and a round coupling head 30 contiguous to and complementary in shape with the neck portion 29 and projecting beyond the sealing member 20. The support portion 28 also projects beyond the sealing member 20 and supports theron the coupling head 30. The support portion 28 has a substantially triangular shape in horizontal cross section tapering away from the leg portion 26 and terminating at an end of the coupling head 30 remote from the neck portion 29. Each coupling element half 24, 25 also includes a rear tongue 31 of reduced width and thickness disposed on the longitudinal tape edge portion 14, 15 and extending away from the coupling head 30. The rear tongues 31, 31 serve to guide thereon a slider (not shown) when the latter is moved to slide along the coupling elements 23.

As shown in FIGS. 1 and 2, a first integral connector 32 of a cylindrical shape extends through a first aperture 33 in the stringer tape 12, 13 and between the support portions of the upper and lower element halves 24, 25, the aperture 33 substantially intersecting the thickened sealing member 20. A second connector 34 of a cylindrical shape, which is larger in diameter than the first connector 32, extends through a second aperture 35 in the longitudinal tape edge portion 14, 15 and between the leg portions 26, 26 of the coupling element halves 24, 25. With this arrangement, the coupling element halves 24, 25 or the coupling elements 23 are anchored in place on the stringer tape 12, 13 as their support portions 28, 28 as well as their legs 26, 26 are interconnected with the stringer tape 12, 13 sandwiched therebetween.

The coupling portions 27, 27 of the coupling element halves 24, 25, and more specifically the support portions 28, 28 of the coupling portions 27, 27 jointly, define therebetween a slot 36 (FIG. 4) extending longitudinally along the thickened sealing member 20 with the sealing surface 21 facing into the slot 36. The coupling portion 27 of each coupling element half 24, 25 has a pair of lateral recesses 37, 37 defined jointly by the support portion 28 and the neck portion 29 and opening away from, general plane of the stringer tape 12, 13.

When the coupling elements 23 of two slide fastener stringers 10, 11 are coupled together, the coupling head 30 of one coupling element 23 on one stringer 10 is received in the recesses 37, 37 in two adjacent ones of the coupling elements 23, 23 on the other stringer 11. The support portions 28, 28 engage the coupling head 30 to limit relative tilting displacement of coupled adjacent coupling elements 23, 23 when the stringer tapes 12, 13 are flexed under longitudinal or lateral bending stresses, or torsional stresses while in use. The support portions 28, 28 of the coupling elements 23 prevent the sealing member 20 from expanding in a direction perpendicular to the plane of the stringer tape 12, 13 at longitudinal portions received in the slot 36 between the support portions 28, 28, and force the longitudinal portions of opposed sealing members 20, 20 to expand edgewise into compressed contact together.

Thus, the sealing members 20, 20 provide a hermetic seal between the slide fastener stringers 10, 11 against water leakage therebetween. As the stringer tapes 12, 13 include the fabric cores 16 having a longitudinal strain or stretch which is substantially smaller than that of the rubber coating on the tapes, the rows of the coupling elements 23, 23 as molded on the respective tapes have an accurate element pitch.

Figure 5:
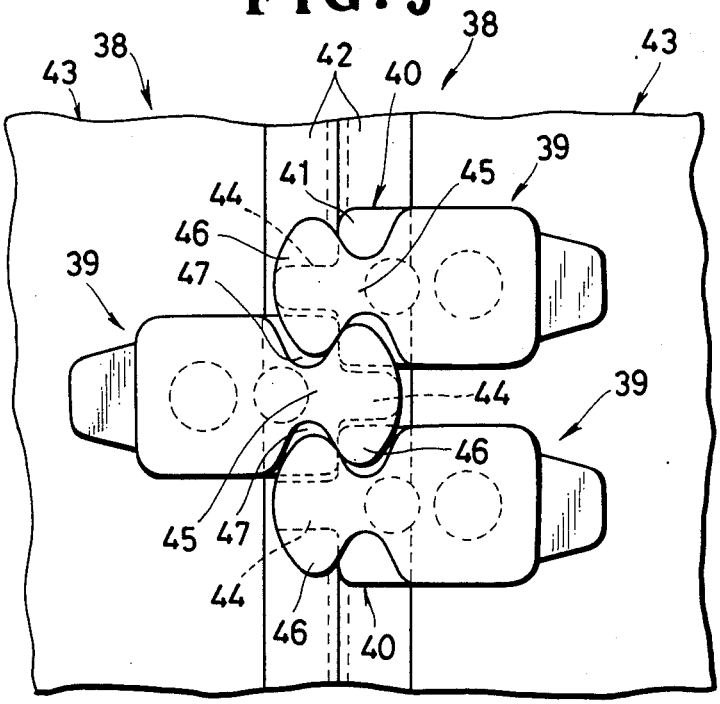
FIGS. 5 and 6 are views respectively similar to FIGS. 1 and 4, showing another embodiment.
Figure 6:
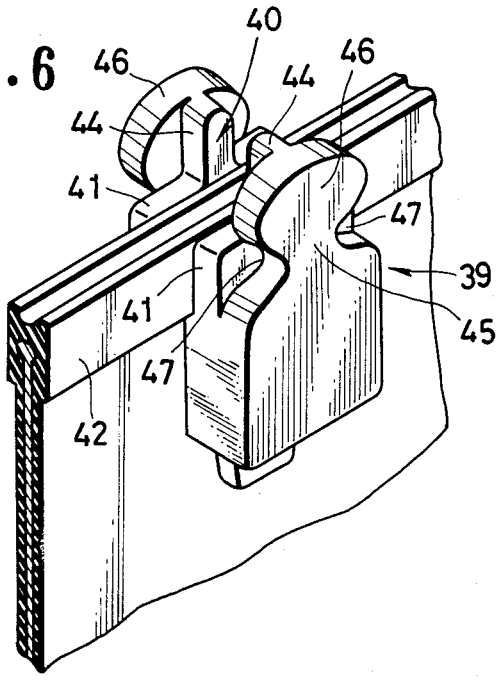

A pair of modified slide fastener stringers 38, 38 shown in FIG. 5 is similar to the ones shown in FIG. 1 at the numerals 10, 11, but differs therefrom in that each coupling element 39 has a pair of upper and lower support portions 40, 40 (FIG. 6) having a substantially T-shaped horizontal cross section. Each of the T-shaped support portions 40, 40 has a support head 41 disposed on and extending transversely across a thickened sealing member 42 of a stringer tape 43, and a leg 44 extending perpendicularly to the support head 41 beyond the sealing member 42. A reduced neck 45 and a round coupling head 46 are disposed on the support 41 and the leg 44, respectively, the neck 45 and the support head 41 jointly defining therebetween a pair of recesses 47, 47 opening away from the plane of the stringer tape 43. This arrangement provides larger supporting areas for the coupling heads 46 of mating coupling elements 39 than the areas provided by the first embodiment. The slide fastener stringers 38, 38 that are coupled together are retained in place against displacement relative to each other, particularly in a direction perpendicular to the plane of the stringer tapes 43, 43.

Figure 7:
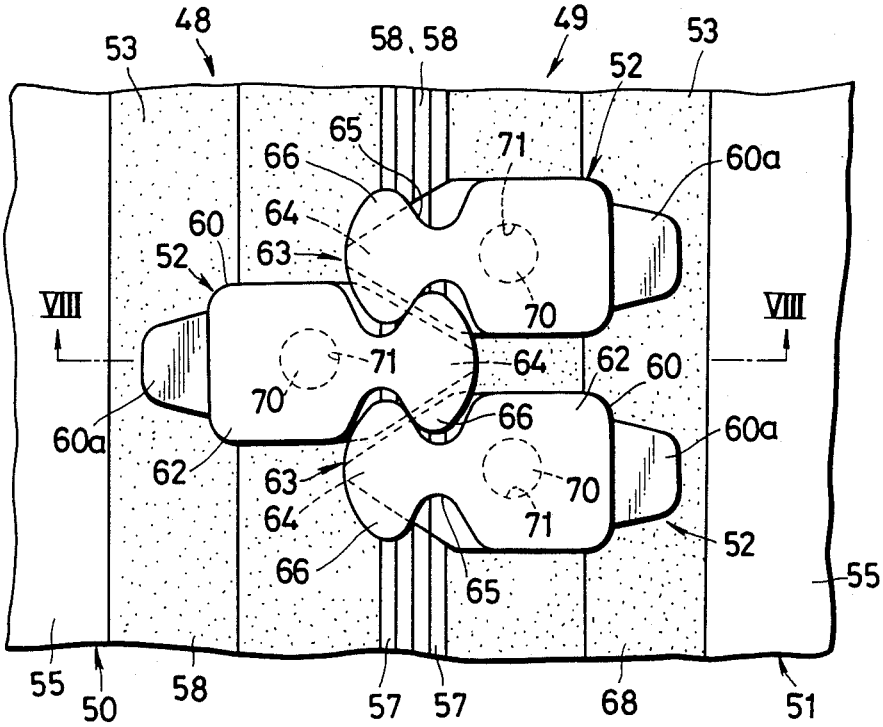
FIG. 7 is a view similar to FIG. 1, showing a further embodiment.
Figure 8:
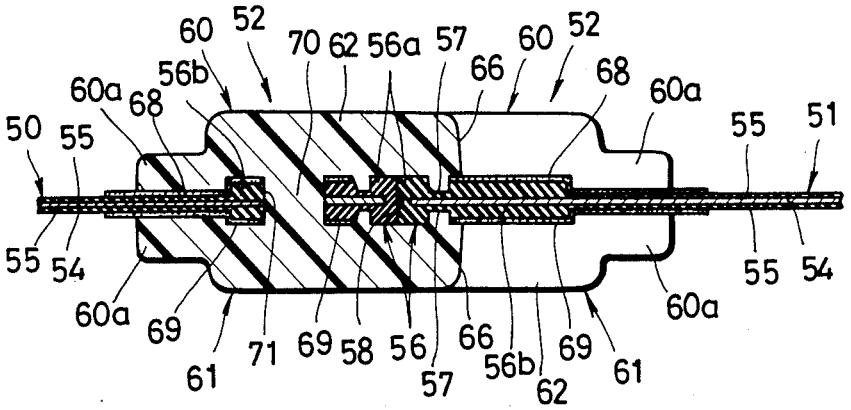
FIG. 8 is a cross-sectional view taken along line VIII—VIII of FIG. 7.
Figure 9:
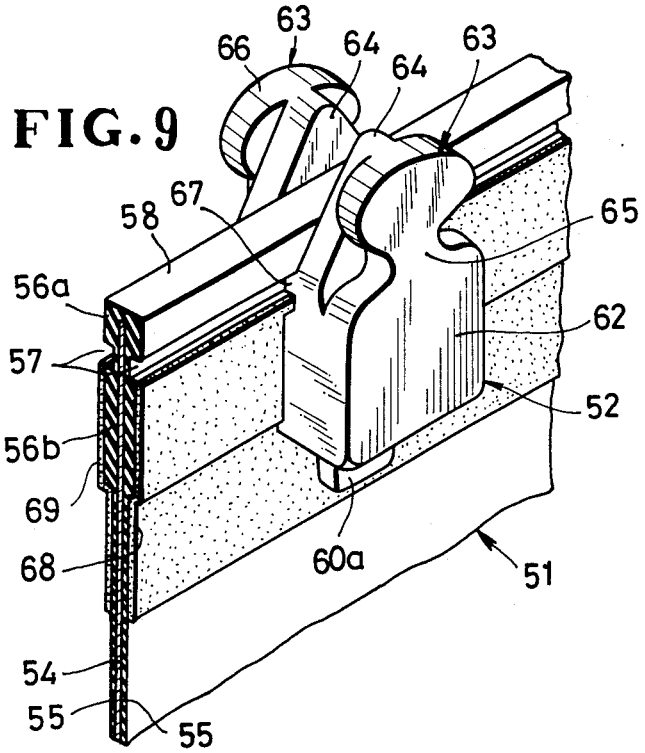
FIG. 9 is a fragmentary perspective view of one of the slide fastener stringers shown in FIG. 7.

As shown in FIGS. 7 and 8, a pair of coupled slide fastener stringers 48, 49 according to another embodiment comprises a pair of stringer tapes 50, 51 respectively supporting a pair of rows of coupling elements 52, 52 (only three being shown in FIG. 7 for clarity) on and along their inner longitudinal edge portions 53, 53. Each of the stringer tapes 50, 51 is composed of a woven or knit web core 54 (FIGS. 8 and 9), and pair of face and back layers 55, 55 of resilient and water-resistant elastomer such as natural or synthetic rubber covering opposite surfaces of the web core 54, the layers 55, 55 being coated or extrusion-molded on the web core 54. Each stringer tape 50, 51 has a thickened or enlarged, resilient sealing member 56 having a thickness greater than that of the tape proper and extending on and along the longitudinal edge portion 53, 53, the sealing member 56 being made of the same material as that of the layers 55, 55. The thickened sealing member 56 has a pair of first and second sealing portions 56a, 56b laterally spaced from one another by a pair of longitudinal grooves 57, 57 opening in opposite directions away from the plane of the stringer tape 50, 51. The first sealing portion 56a, which is located on and around the extremity of the longitudinal tape edge portion 53, 53, is smaller in width than the second sealing portion 56b and has a sealing edge or surface 58 lying in a plane substantially perpendicular to the stringer tape 50, 51. When the slide fastener stringers 48, 49 are coupled together, the sealing surfaces 58, 58 are pressed against each other, thereby providing a hermetic seal between the fastener stringers 48, 49 against water leakage therebetween.

As shown in FIG. 8, each of the coupling elements 52 comprises a pair of upper and lower members or halves 60, 61 disposed one on each side of the stringer tape 50, 51. Each coupling element half 60, 61 includes a wide leg portion 62 disposed substantially on the second sealing portion 56b, and a coupling portion 63 extending from the leg portion 62 across a corresponding one of the grooves 57, 57 and projecting beyond the first sealing portion 56a. The coupling portion 63 includes a support portion 64 extending from the leg portion 62 and disposed on both the first and second sealing portions 56a, 56b, a reduced neck portion 65 disposed on the support portion 64 and exending from the leg portion 62, and a round coupling head 66 integral with the neck portion 65 and projecting beyond the first sealing portion 56a. The support portion 64 has on its underside a rib 67 (FIG. 9) received in the groove 57. The support portion 64 is substantially triangularly shaped as viewed from the plane of the stringer 48, 49, tapering toward and terminating at an end of the coupling head 66 remote from the neck portion 65.

Each coupling element half 60, 61 also has a rear tongue 60a of reduced width and thickness disposed on the longitudinal tape edge portion 53 and extending away from the coupling head 66.

A pair of layers 68, 69 of a cured adhesive such as a mixture of a rubber cement and a hardening agent, covers opposite surfaces of the resilient and water-resistant layers 55, 55, respectively, and firmly bonds the stringer tape 50, 51 and the coupling elements 52. The adhesive layers 68, 69 extend longitudinally along the second seal portion 56b and a portion of the longitudinal tape edge 53 adjacent to the second seal portion 56b.

As shown in FIGS. 7 and 8, an integral connector 70 of a cylindrical shape extends through an aperture 71 in the stringer tape 50, 51 and between the leg portions 62 of the coupling element halves 60, 61. With this arrangement, the coupling elements 52 are anchored in place on the stringer tape 50, 51 as their leg portions 62, 62 are interconnected by the connectors 70 with the stringer tape 50, 51 sandwiched therebetween. The coupling elements 52 are made of synthetic resin or metal and are mounted either by molding or by die-casting after the mixture of the adhesive and the hardening agent is coated on opposite sides of the stringer tape 50, 51 to form precured adhesive layers thereon.

In molding or die-casting of the coupling elements 52, the precured adhesive layers, being cured, firmly bond the coupling elements 52 to the stringer tape 50, 51. The adhesive layers 68, 69 may be applied to the stringer tape 50, 51 only at areas on which the coupling elements 52 are disposed. Alternatively, it may be sufficient to apply the adhesive layers 68, 69 to the stringer tape 50, 51 only around the apertures 71 so that water can be prevented from penetrating through the coupled slide fastener stringers 48, 49 around the connector 70 even when a great amount of pressure difference is created between the opposite sides of the fastener stringers 48, 49. The slide fastener stringers 48, 49 thus arranged are reliable in fluid-tightness for a wide variety of severe applications, such as for use in a heavy duty diving suit.

Although various minor modifications may be suggested by those versed in the art, it should be understood that I wish to embody within the scope of the patent warranted hereon, all such embodiments as reasonably and properly come within the scope of my contribution to the art.

I claim as my invention:

1. A watertight slide fastener comprising:

(a) a pair of waterproof stringer tapes, each tape having a thickened sealing member along a longitudinal edge portion thereof, said thickened sealing member having a sealing surface facing toward and sealingly engageable with the sealing surface of the thickened sealing member of the opposed stringer tape, and each of said stringer tapes generally defining a plane; and (b) a series of coupling elements mounted on said longitudinal edge portion of each said tape, each of said coupling elements comprising a pair of members mounted one on each side of said stringer tape, and at least one integral connector extending through said longitudinal edge portion and interconnecting said pair of coupling element members, each said coupling element member having, (1) a leg portion disposed on said longitudinal edge portion, (2) a coupling portion having a head joined by a neck to said leg portion and extending partly beyond said thickened sealing member, (3) a support portion extending from said leg portion and disposed between said coupling portion and said thickened sealing member, and also disposed flatwise against and projecting beyond said thickened sealing member and integral with said coupling portion, and (4) said support portion and said neck jointly defining a pair of recesses opening away from the general plane of said stringer tape, for receiving therein said coupling heads of two adjacent coupling elements of the opposed stringer tape, said support portion being engageable with the last-mentioned coupling heads to limit relative tilting displacement of coupled adjacent coupling elements when said stringer tapes are flexed under longitudinal or lateral bending stresses as well as torsional stresses while in use, (5) said support portions of said pair of members jointly defining therebetween a slot extending longitudinally along said thickened sealing member for receiving therein longitudinal portions of said thickened sealing member of the opposed stringer tape, said sealing member having a surface facing into said slot, said support portions being engageable flatwise with said longitudinal portions to prevent the latter from expanding in a direction perpendicular to the plane of said stringer tapes and to force said longitudinal portions of opposed thickened sealing members to expand edgewise into compressed contact together.

2. A watertight slide fastener stringer according to claim 1, said support portion having a substantially T-shape in horizontal cross section and including a support head disposed on and extending transversely across said sealing member, and a leg extending perpendicularly to said support head beyond said sealing member, said neck and said coupling head being disposed respectively on said support head and said leg, said recesses being defined by said neck and said head of said support portion.

3. A watertight slide fastener stringer according to claim 1, said thickened sealing member having a pair of laterally spaced first and second flat sealing portions, and a pair of grooves disposed one on each side of said sealing member and each lying between said first and second flat sealing portions, said support portion spanning said first and second sealing portions and having a rib received in a corresponding one of said grooves, said leg portion being disposed on said second flat sealing portion.

4. A watertight slide fastener according to claim 1 including a layer of cured adhesive mixture of rubber cement and hardening agent disposed on each side of said watertight stringer tape serving as waterproofing at least around said integral connector.

5. A watertight slide fastener stringer according to claim 4, said support portion having a substantially T-shape in horizontal cross section and including a support head disposed against and extending transversely across said sealing member, and a leg extending perpendicularly to said support head beyond said sealing member, said neck and said coupling head being disposed respectively on said support head and said leg, said recesses being defined by said neck and said head of said support portion.

6. A watertight slide fastener stringer according to claim 4, said thickened sealing member having a pair of laterally spaced first and second flat sealing portions, said support portion having a rib extending between said first and second flat sealing portions, said leg portion being substantially disposed on said second flat sealing portion, said adhesive layer extending on each side of said second flat sealing portion along the length of said sealing member.

7. A watertight slide fastener comprising:

(a) a pair of waterproof stringer tapes, each tape having a thickened sealing member along a longitudinal edge portion thereof, said thickened sealing member having a sealing surface facing toward and sealingly engageable with the sealing surface of the thickened sealing member of the opposed stringer tape, and each of said stringer tapes generally defining a plane;

(b) a series of coupling elements mounted on said longitudinal edge portion of each said tape, each of said coupling elements comprising a pair of members mounted one on each side of said stringer tape, and at least one integral connector extending through said longitudinal edge portion and interconnecting said pair of coupling element members, each said coupling element member having, (1) a leg portion disposed on said longitudinal edge portion, (2) a coupling portion having a head joined by a neck to said leg portion and extending partly beyond said thickened sealing member, (3) a support portion extending from said leg portion and disposed between said coupling portion and said thickened sealing member, and also disposed flatwise against and projecting beyond said thickened sealing member and integral with said coupling portion, and (4) said support portion and said neck jointly defining a pair of recesses opening away from the general plane of said stringer tape;

(c) said support portions of said pair of members jointly defining therebetween a slot extending longitudinally along said thickened sealing member, said sealing member having a surface facing into said slot;

(d) a layer of cured adhesive material which is a mixture of rubber cement and hardening agent disposed on each side of said watertight stringer tape serving as waterproofing at least around said integral connector; and (e) said stringer tape being composed of a fabric web core, and a pair of flat layers of resilient and water-resistant elastomer covering opposite sides of said web core along a longitudinal edge thereof, said sealing member being integral with said flat layers and made of the same material as that of said flat layers, said layer of cured adhesive material extending on each side of said sealing member.

* * * * *